US011521562B2

(12) United States Patent
Kim et al.

(10) Patent No.: US 11,521,562 B2
(45) Date of Patent: Dec. 6, 2022

(54) DISPLAY DEVICE AND DRIVING METHOD THEREOF

(71) Applicant: LG DISPLAY CO., LTD., Seoul (KR)

(72) Inventors: SungJoong Kim, Paju-si (KR); GaYong Park, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/487,568

(22) Filed: Sep. 28, 2021

(65) Prior Publication Data

US 2022/0157261 A1 May 19, 2022

(30) Foreign Application Priority Data

Nov. 13, 2020 (KR) ..... 10-2020-0152230

(51) Int. Cl.
*G09G 3/3291* (2016.01)
*G09G 3/3266* (2016.01)
*G09G 3/3233* (2016.01)

(52) U.S. Cl.
CPC ..... *G09G 3/3291* (2013.01); *G09G 3/3266* (2013.01); *G09G 2300/0842* (2013.01); *G09G 2310/08* (2013.01); *G09G 2320/0233* (2013.01); *G09G 2360/16* (2013.01)

(58) Field of Classification Search
CPC ..... G09G 2320/029
See application file for complete search history.

(56) References Cited

U.S. PATENT DOCUMENTS

2010/0053204 A1* 3/2010 Hwang ..... G09G 3/3648 345/618
2016/0078805 A1* 3/2016 Woo ..... G09G 3/3225 345/78
2016/0148561 A1* 5/2016 Park ..... G09G 3/3225 345/76
2016/0351095 A1* 12/2016 Tani ..... G09G 3/3283
2017/0154573 A1* 6/2017 Woo ..... G09G 3/3233
2019/0189038 A1* 6/2019 Park ..... G09G 3/006
2020/0152135 A1* 5/2020 Kang ..... G09G 3/3266
2020/0160789 A1* 5/2020 Park ..... G09G 3/3258
2021/0043148 A1* 2/2021 Lee ..... G09G 3/3291
2021/0295776 A1* 9/2021 Kim ..... G09G 3/3233
2022/0139299 A1* 5/2022 Pyun ..... G09G 3/006 345/204

* cited by examiner

*Primary Examiner* — Sepehr Azari
(74) *Attorney, Agent, or Firm* — Morgan, Lewis & Bockius LLP

(57) ABSTRACT

Embodiments of the present disclosure relate to a display device including a display panel having a plurality of gate lines extending in a first direction, a plurality of data lines extending in a second direction, and a plurality of subpixels; a gate driving circuit for supplying scan signals to the plurality of gate lines; a data driving circuit for supplying data voltages to the plurality of data lines and including a sensing circuit of characteristic value to sense the characteristic value of the plurality of subpixels; and a timing controller for controlling the gate driving circuit and the data driving circuit, and determining a defective line by detecting a distorted section for the sensed characteristic value for each subpixel arranged in the second direction in respect to a plurality of blocks corresponding to the display panel.

12 Claims, 17 Drawing Sheets

(a)

(b)

(a) (b)

DISPLAY DEVICE AND DRIVING METHOD THEREOF

CROSS REFERENCE TO RELATED APPLICATION

This application claims priority from Korean Patent Applications No. 10-2020-0152230, filed on Nov. 13, 2020, which are hereby incorporated by reference for all purposes as if fully set forth herein.

BACKGROUND

Technical Field

Embodiments of the present disclosure relate to a display device and a driving method thereof for detecting accurately a deviation of a characteristic value.

Discussion of the Related Art

With the development of the information society, there has been an increasing demand for a variety of types of image display devices. In this regard, a range of display devices, such as liquid crystal display device, and electroluminescence display device, have recently come into widespread use.

Among such display devices, the electroluminescence display devices have superior properties, such as rapid response speeds, high contrast ratios, high emissive efficiency, high luminance, and wide viewing angles, since self-emissive light emitting diodes are used. In this case, the light emitting diode may be implemented with an inorganic material or an organic material.

Such an electroluminescence display device may include organic light emitting diodes disposed in a plurality of subpixels aligned in a display panel, and may control the organic light emitting diodes to emit light by controlling a voltage flowing through the organic light emitting diodes, so as to display an image while controlling luminance of the subpixels.

In such an electroluminescence display device, the light emitting diode and a driving transistor to drive the light emitting diode are disposed in each subpixel defined in the display panel. At this time, there may be deviations in the characteristics of transistors in each subpixel such as threshold voltage or mobility, due to variations over the driving time or different driving times among the subpixels. As a result, luminance deviation (luminance non-uniformity) between subpixels may occur, and image quality may be degraded.

Accordingly, a technology for sensing and compensating a characteristic value of a driving transistor such as a threshold voltage or mobility in the electroluminescence display device has been proposed in order to solve the luminance deviation between subpixels. However, there is a still problem that the luminance non-uniformity of the display image is caused during the sensing and compensation process of the characteristic value.

In particular, the characteristic values in a specific area may be changed due to high temperature heat generated during an operation of the driving circuit disposed in the display device or environmental factors (temperature, humidity, etc.) transmitted from an outside. Accordingly, a problem that a distortion occurs during the compensation process may be arisen.

Therefore, in recent years, research for effectively compensating the characteristic value for the display device and detecting an error in the compensation process of the characteristic value has been performed.

However, when the process for detecting the luminance deviation of subpixels is performed for the entire range of the display panel, it may be difficult to detect the luminance distortion in a local area.

In addition, it is difficult to accurately detect and compensate the deviation of the characteristic value due to differences between data voltages supplied through adjacent data lines disposed in the display panel.

SUMMARY

Accordingly, embodiments of the present disclosure are directed to a display device and a driving method thereof that substantially obviates one or more of the problems due to limitations and disadvantages of the related art.

As such, the inventors of the present disclosure invented a display device and a driving method thereof capable of accurately detecting and compensating the deviations of characteristic values for local areas of the display panel.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises a display panel including a plurality of gate lines extending in a first direction, a plurality of data lines extending in a second direction, and a plurality of subpixels; a gate driving circuit for supplying scan signals to the plurality of gate lines; a data driving circuit for supplying data voltages to the plurality of data lines and including a sensing circuit of characteristic value to sense the characteristic value of the plurality of subpixels; and a timing controller for controlling the gate driving circuit and the data driving circuit, and determining a defective line by detecting a distorted section for the sensed characteristic value for each subpixel arranged in the second direction in respect to a plurality of blocks corresponding to the display panel.

In the display device according to an embodiment of present disclosure, the plurality of subpixels include: a light emitting element; a driving transistor providing current to the light emitting element; a switching transistor electrically connected between a gate node of the driving transistor and the data line; a sensing transistor electrically connected between a source node or a drain node of the driving transistor and a reference voltage line; and a storage capacitor electrically connected between a gate node and a source node or a drain node of the switching transistor.

In the display device according to an embodiment of present disclosure, the sensing circuit of characteristic value includes: an amplifier in which an inverting input terminal is connected to a reference voltage line connected to a source node or a drain node of the sensing transistor and a non-inverting input terminal to be supplied a reference voltage-for-comparing; a feedback capacitor electrically connected between the inverting input terminal and an output terminal of the amplifier; an initializing switch connected in parallel with the feedback capacitor; and a sampling switch located at the output terminal of the amplifier.

In the display device according to an embodiment of present disclosure, the timing controller divides the sensed characteristic value of the display panel for each block, removes noise of the sensed characteristic value for each block, removes noise of the sensed characteristic value for each subpixel arranged in the second direction, and determines a defective line by detecting a distorted section of the sensed characteristic value for each subpixel arranged in the second direction.

In the display device according to an embodiment of present disclosure, the timing controller calculates a deviation of the sensed characteristic values for each block by comparing an average of the sensed characteristic values for each block with an average of the sensed characteristic values in the entire display panel, and removes the noise of the sensed characteristic value by normalizing the sensed characteristic values for each block with the deviation of the sensed characteristic values.

In the display device according to an embodiment of present disclosure, the timing controller calculates a slope of the sensed characteristic value except the sensed characteristic value for an edge portion of the subpixels arranged in the second direction, detects a high slope area in which a slope of the sensed characteristic value is equal to or greater than a reference slope, calculates a distance between inflection points of the sensed characteristic value in the high slope area, and determines a case in which the distance between the inflection points of the sensed characteristic value is equal to or greater than a reference distance as the defective line.

In the display device according to an embodiment of present disclosure, the timing controller further includes a compensating circuit for providing compensation data with different compensation gains to blocks with the defective lines as data voltage.

In the display device according to an embodiment of present disclosure, the timing controller determines the display panel as a defective product when the detected defective lines exceed a reference number.

In another aspect, a driving method of a display device including a display panel comprised of a plurality of gate lines extending in a first direction, a plurality of data lines extending in a second direction, and a plurality of subpixels, a gate driving circuit for supplying scan signals to the plurality of gate lines, and a data driving circuit for supplying data voltages to the plurality of data lines and sensing a characteristic value of the plurality of subpixels, comprises dividing the sensed characteristic value into units of blocks; removing noise from the sensed characteristic value for each block; removing noise from the sensed characteristic value for each subpixel arranged in the second direction; and determining a defective line by detecting a distorted section for the sensed characteristic value for each subpixel arranged in the second direction.

According to embodiments of the present disclosure, it is possible to provide a display device and a driving method thereof capable of accurately detecting and compensating the deviation of the characteristic value for local areas of the display panel.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
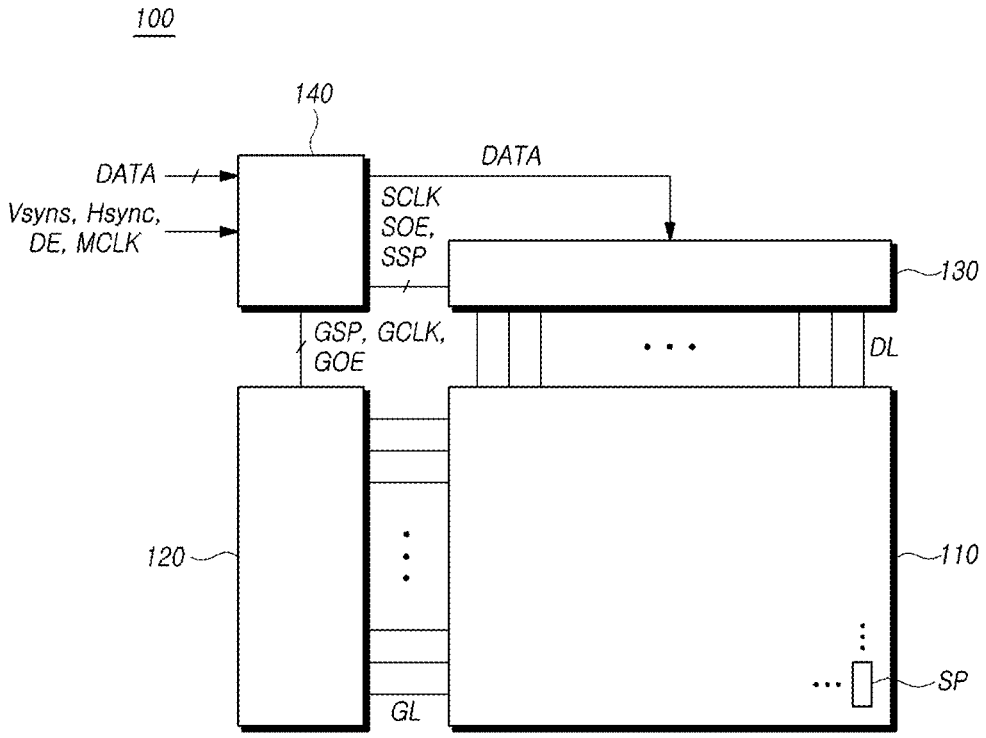
FIG. 1 illustrates a schematic diagram of a display device according to embodiments of the present disclosure.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in a variety of different forms. Rather, these embodiments are provided so that the present disclosure will be thorough and complete, and will fully convey the scope of the present disclosure to those having ordinary knowledge in the technical field. The scope of the present disclosure shall be defined by the appended claims.

The shapes, sizes, ratios, angles, numbers, and the like, inscribed in the drawings to illustrate exemplary embodiments are illustrative only, and the present disclosure is not limited to the embodiments illustrated in the drawings. Throughout this document, the same reference numerals and symbols will be used to designate the same or like components. In the following description of the present disclosure, detailed descriptions of known functions and components incorporated into the present disclosure will be omitted in the situation in which the subject matter of the present disclosure may be rendered unclear thereby. It will be understood that the terms "comprise", "include", "have", and any variations thereof used herein are intended to cover non-exclusive inclusions unless explicitly described to the contrary. Descriptions of components in the singular form used herein are intended to include descriptions of components in the plural form, unless explicitly described to the contrary.

In the analysis of a component, it shall be understood that an error range is included therein, even in the situation in which there is no explicit description thereof.

When spatially relative terms, such as "on", "above", "under", "below", and "on a side of", are used herein for descriptions of relationships between one element or component and another element or component, one or more intervening elements or components may be present between the one and other elements or components, unless a term, such as "directly", is used.

When temporally relative terms, such as "after", "subsequent", "following", and "before" are used to define a temporal relationship, a non-continuous case may be included unless the term "immediately" or "directly" is used.

In descriptions of signal transmission, such as "a signal is sent from node A to node B", a signal may be sent from node A to node B via another node unless the term "immediately" or "directly" is used.

In addition, terms, such as "first" and "second" may be used herein to describe a variety of components. It should be understood, however, that these components are not limited by these terms. These terms are merely used to discriminate one element or component from other elements or components. Thus, a first component referred to as first hereinafter may be a second component within the spirit of the present disclosure.

The features of exemplary embodiments of the present disclosure may be partially or entirely coupled or combined with each other and may work in concert with each other or may operate in a variety of technical methods. In addition, respective exemplary embodiments may be carried out independently or may be associated with and carried out in concert with other embodiments.

Hereinafter, a variety of embodiments will be described in detail with reference to the accompanying drawings.

FIG. 1 illustrates a schematic diagram of a display device according to embodiments of the present disclosure.

Referring to FIG. 1, the display device 100 according to embodiments of the present disclosure may include a display panel 110 connected to a plurality of gate lines GL and a plurality of data lines DL in which a plurality of subpixels SP are arranged in rows and columns, a gate driving circuit 120 for supplying scan signals to the plurality of gate lines GL and a data driving circuit 130 for supplying data voltages to the plurality of data lines DL, and a timing controller 140 for controlling the gate driving circuit 120 and the data driving circuit 130.

The display panel 110 displays an image based on the scan signals supplied from the gate driving circuit 120 through the plurality of gate lines GL and the data voltages supplied from the data driving circuit 130 through the plurality of data lines DL.

In the case of a liquid crystal display, the display panel 110 includes a liquid crystal layer formed between two substrates, and may be operated in any known mode such as TN (Twisted Nematic) mode, VA (Vertical Alignment) mode, IPS (In Plane Switching) mode, FFS (Fringe Field Switching) mode. In the case of an electroluminescence display device, the display panel 110 may be implemented in a top emission method, a bottom emission method, or a dual emission method.

In the display panel 110, a plurality of pixels may be disposed in a matrix form. Each pixel may be composed of subpixels SP of different colors, for example, a white subpixel, a red subpixel, a green subpixel, and a blue subpixel. Each subpixel SP may be defined by the plurality of the data lines DL and the plurality of the gate lines GL.

A subpixel SP may include a thin film transistor (TFT) arranged in a region where a data line DL and a gate line GL intersect, a light emitting element such as an light emitting diode which is emitted according to the data voltage, and a storage capacitor for maintaining the data voltage by being electrically connected to the light emitting element.

For example, when the display device 100 having a resolution of 2,160×3,840 includes four subpixels SP of white W, red R, green G, and blue B, 3,840×4=15,360 data lines DL may be provided by 2,160 gate lines GL and 3,840 data lines DL respectively connected to 4 subpixels WRGB. Each of the plurality of subpixels SP may be disposed in areas in which the plurality of gate lines GL overlap the plurality of data lines DL.

The gate driving circuit 120 is controlled by the timing controller 140, and controls the driving timing of the plurality of subpixels SP by sequentially supplying the scan signals to the plurality of gate lines GL disposed in the display panel 110.

In the display device 100 having a resolution of 2,160×3,840, an operation of sequentially supplying the scan signals to the 2,160 gate lines GL from the first gate line GL1 to the 2,160th gate line GL2160 may be referred to as 2,160-phase driving operation. Otherwise, an operation of sequentially supplying the scan signals to every four gate lines GL, as in a case in which the scan signals are supplied sequentially from first gate line GL1 to fourth gate lines GL4, and then are supplied sequentially from fifth gate line GL5 to eighth gate line GL8, may be referred to as 4-phase driving operation. As described above, an operation in which the scan signals are supplied sequentially to every N number of gate lines may be referred as N-phase driving operation.

The gate driving circuit 120 may include one or more gate driving integrated circuits (GDIC), which may be disposed on one side or both sides of the display panel 110 depending on the driving method. Alternatively, the gate driving circuit 120 may be implemented in a gate-in-panel (GIP) structure embedded in a bezel area of the display panel 110.

The data driving circuit 130 receives digital image data DATA from the timing controller 140, and converts the received digital image data DATA into an analog data voltage. Then, the data driving circuit 130 supplies the analog data voltage to each of the data lines DL at time which the scan signal is supplied through the gate line GL, so that each of the subpixels SP connected to the data lines DL emits light with a corresponding luminance in response to the analog data voltage.

Likewise, the data driving circuit 130 may include one or more source driving integrated circuits (SDIC). Each of the source driving integrated circuits SDIC may be connected to a bonding pad of the display panel 110 by a tape automated bonding (TAB) or a chip on glass (COG), or may be directly mounted on the display panel 110.

In some cases, each of the source driving integrated circuits (SDIC) may be integrated with the display panel 110. In addition, each of the source driving integrated circuits (SDIC) may be implemented with a chip on film (COF) structure. In this case, the source driving integrated circuit SDIC may be mounted on circuit film to be electrically connected to the data lines DL in the display panel 110 via the circuit film.

The timing controller 140 supplies various control signals to the gate driving circuit 120 and the data driving circuit 130, and controls the operations of the gate driving circuit 120 and the data driving circuit 130. That is, the timing controller 140 controls the gate driving circuit 120 to supply the scan signals in response to a time realized by respective frames, and on the other hand, transmits the digital image data DATA from an external source to the data driving circuit 130.

Here, the timing controller 140 receives various timing signals, including a vertical synchronization signal Vsync, a horizontal synchronization signal Hsync, a data enable signal DE, and a main clock MCLK, from an external source (e.g., a host system). Accordingly, the timing controller 140 generates control signals using the various timing signals received from the external source, and supplies the control signals to the gate driving circuit 120 and the data driving circuit 130.

For example, the timing controller 140 generates various gate control signals, including a gate start pulse GSP, a gate clock GCLK, and a gate output enable signal GOE, to control the gate driving circuit 120. Here, the gate start pulse GSP is used to control the start timing of one or more gate driving integrated circuits GDIC of the gate driving circuit 120. In addition, the gate clock GCLK is a clock signal commonly supplied to the one or more gate driving integrated circuits GDIC for controlling the shift timing of the scan signals. The gate output enable signal GOE designates timing information of the one or more gate driving integrated circuits GDIC.

In addition, the timing controller 140 generates various data control signals, including a source start pulse SSP, a source sampling clock SSC, and a source output enable signal SOE, to control the data driving circuit 130. Here, the source start pulse SSP is used to control the start timing for the data sampling of one or more source driving integrated circuits SDIC of the data driving circuit 130. The source sampling clock SSC is a clock signal for controlling a timing of data sampling in each of the source driving integrated circuits SDIC. The source output enable signal SOE controls the output timing of the data driving circuit 130.

The display device 100 may further include a power management integrated circuit for supplying or controlling various voltage or current to the display panel 110, the gate driving circuit 120, and the data driving circuit 130.

A light emitting element may be disposed in each of the subpixels SP. For example, the electroluminescence display device may include a light emitting element, such as a light emitting diode in each of the subpixels SP, and may display an image by controlling current flowing through the light emitting elements in response to the data voltage.

Figure 2:
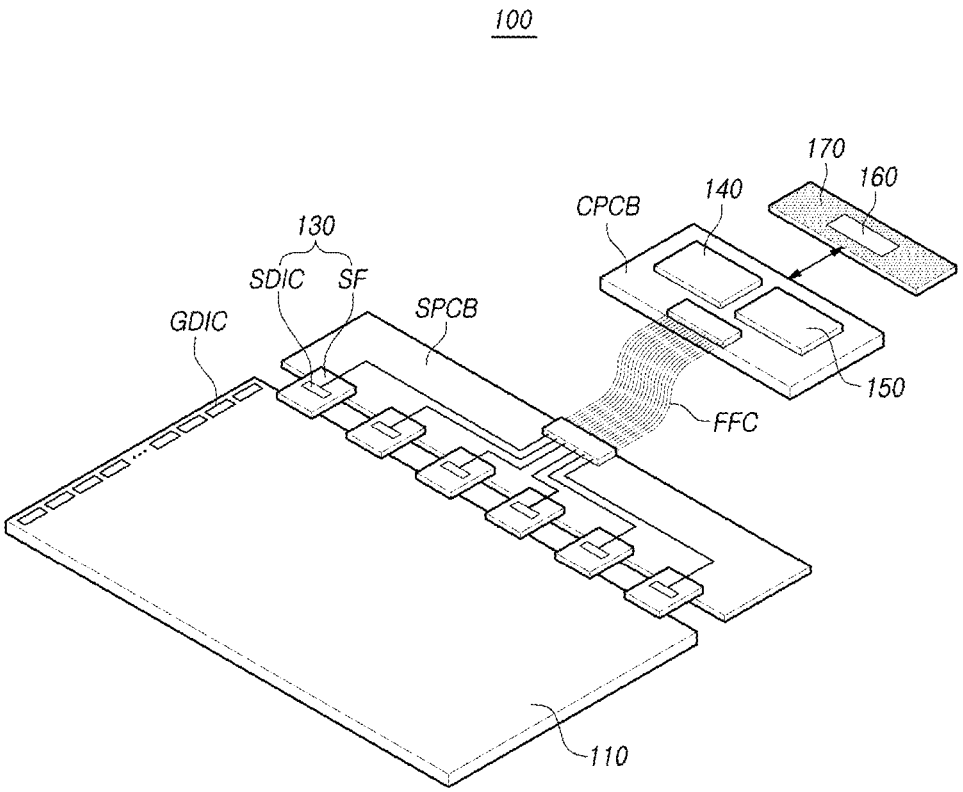
FIG. 2 illustrates a system diagram of the display device according to embodiments of the present disclosure.

FIG. 2 illustrates a system diagram of the display device according to embodiments of the present disclosure.

As an example, FIG. 2 illustrates that each of the source driving integrated circuits SDIC of the data driving circuit 130 in the display device 100 according to embodiments of the present disclosure is implemented with a COF type among various structures among various structures such as a TAB, a COG, and a COF, and the gate driving circuit 120 is implemented with a GIP type among various structures such as a TAB, a COG, a COF, and a GIP.

When the gate driving circuit 120 is implemented in a GIP type, the plurality of gate driving integrated circuits GDIC of the gate driving circuit 120 may be directly formed in a non-display area of the display panel 110. At this time, the gate driving integrated circuits GDIC may receive various signals (e.g., clock signal, gate high signal, gate low signal, etc.) necessary for generating the scan signal through the signal lines related to gate driving operation arranged in the non-display area.

Likewise, the data driving circuit 130 may include one or more source driving integrated circuits SDIC, which may be mounted on a source film SF, respectively. One portion of the source film SF may be electrically connected to the display panel 110. In addition, electrical lines may be disposed on the source films SF to electrically connect the source driving integrated circuits SDIC and the display panel 110.

The display device 100 may include at least one source printed circuit board SPCB in order to connect the plurality of source driving integrated circuits SDIC to other devices by electrical circuit, and a control printed circuit board CPCB in order to mount various control components and electric elements.

The other portion of the source film SF, on which the source driving integrated circuit SDIC is mounted, may be connected to the at least one source printed circuit board SPCB. That is, one portion of source film SF on which the source driving integrated circuit SDIC is mounted may be electrically connected to the display panel 110, and the other portion of the source film SF may be electrically connected to the source printed circuit board SPCB.

The timing controller 140 and a power management integrated circuit 150 may be mounted on the control printed circuit board CPCB. The timing controller 140 may control the operations of the data driving circuit 130 and the gate driving circuit 120. The power management integrated circuit 150 may supply a driving voltage and a driving current, or control a voltage and a current for the data driving circuit 130 and the gate driving circuit 120.

At least one source printed circuit board SPCB and the control printed circuit board CPCB may have circuitry connection by at least one connecting member. The connecting member may be, for example, a flexible printed circuit FPC, a flexible flat cable FFC, or the like. At least one source printed circuit board SPCB and the control printed circuit board CPCB may be integrated into a single printed circuit board.

The display device 100 may further include a set board 170 electrically connected to the control printed circuit board CPCB. The set board 170 may also be referred to as a power board. A main power management circuit M-PMC 160 managing overall power of the display device 100 may be located on the set board 170. The main power management circuit 160 may be coupled to the power management integrated circuit 150.

In the display device 100 having the above described configuration, a driving voltage is generated by the set board 170 to be supplied to the power management integrated circuit 150. The power management integrated circuit 150 supplies the driving voltage, which is required for a display driving operation or a sensing operation of the characteristic value, to the source printed circuit board SPCB through the flexible printed circuit FPC or the flexible flat cable FFC. The driving voltage supplied to the source printed circuit board SPCB, is transmitted via the source driving integrated circuits SDIC, to emit or sense a specific subpixel SP in the display panel 110.

Each of the subpixels SP arranged in the display panel 110 of the display device 100 may include a light emitting element and circuit elements, such as a driving transistor to drive it.

The type and number of the circuit elements constituting each of the subpixels SP may be variously determined depending on the function, the design, or the like.

Figure 3:
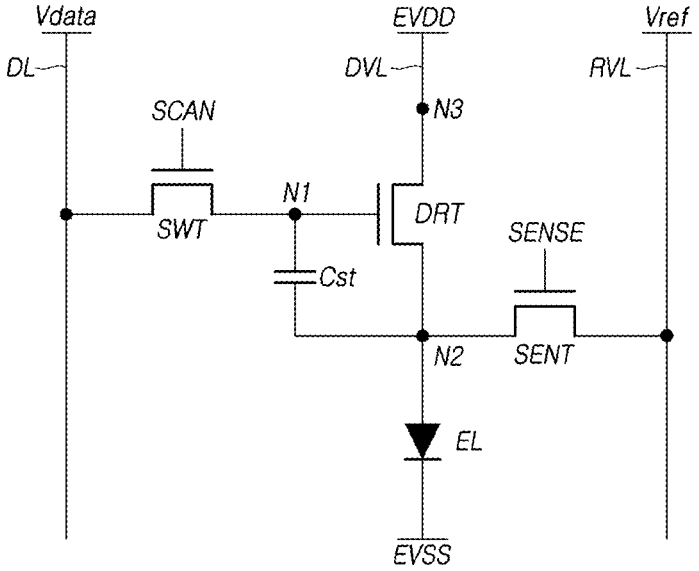
FIG. 3 illustrates a circuit diagram of a subpixel in the display device according to embodiments of the present disclosure.

FIG. 3 illustrates a circuit diagram of a subpixel in the display device according to embodiments of the present disclosure.

Referring to FIG. 3, each of the subpixels SP arranged in the display device 100 according to embodiments of the present disclosure may include one or more transistors, a capacitor, and a light emitting element.

For example, a subpixel SP may include a driving transistor DRT, a switching transistor SWT, a sensing transistor SENT, a storage capacitor Cst, and a light emitting diode EL.

The driving transistor DRT may have a first node N1, a second node N2, and a third node N3. The first node N1 of the driving transistor DRT may be a gate node to be supplied a data voltage Vdata through a data line DL when the switching transistor SWT is turned on. The second node N2 of the driving transistor DRT may be electrically connected to an anode electrode of the light emitting diode EL, and may be a drain node or a source node. The third node N3 of the driving transistor DRT may be electrically connected to a driving voltage line DVL to be supplied a driving voltage EVDD, and may be a source node or a drain node.

Here, the driving voltage EVDD for displaying an image may be supplied to the driving voltage line DVL in the display driving period. For example, the driving voltage EVDD for displaying the image may be about 27V.

The switching transistor SWT is electrically connected between the first node N1 of the driving transistor DRT and the data line DL, and operates in response to a scan signal SCAN supplied thereto through the gate line GL connected to the gate node. In addition, it controls the operation of the driving transistor DRT by transmitting the data voltage Vdata through the data line DL to the gate node of the driving transistor DRT when the switching transistor SWT is turned on.

The sensing transistor SENT is electrically connected between the second node N2 of the driving transistor DRT and a reference voltage line RVL, and operates in response to a sense signal SENSE supplied through the gate line GL connected to a gate node. When the sensing transistor SENT is turned on, a reference voltage-for-sensing Vref supplied from the reference voltage line RVL is transmitted to the second node N2 of the driving transistor DRT.

That is, the voltages of the first node N1 and the second node N2 of the driving transistor DRT may be controlled by controlling the switching transistor SWT and the sensing transistor SENT. Consequently, a current for emitting the light emitting diode EL may be supplied.

Each gate node of the switching transistor SWT and the sensing transistor SENT may be connected to a single gate line GL or to different gate lines GL. Here, it illustrates an exemplary structure of which the switching transistor SWT and the sensing transistor SENT are connected to a different gate lines GL. In this case, the switching transistor SWT and the sensing transistor SENT are controlled independently by the scan signal SCAN and the sense signal SENSE transmitted from the different gate lines GL.

On the other hand, when the switching transistor SWT and the sensing transistor SENT are connected to single gate line GL, the switching transistor SWT and the sensing transistor SENT are controlled simultaneously by the scan signal SCAN or the sense signal SENSE transmitted from the single gate line GL, and thus the aperture ratio of the subpixels SP may be improved.

In addition, the transistors disposed in the subpixels SP may be not only n-type transistors, but also p-type transistors. Herein, it illustrates the exemplary structure of the n-type transistors.

The storage capacitor Cst is electrically connected between the first node N1 and the second node N2 of the driving transistor DRT, and serves to maintain the data voltage Vdata during a frame.

Such a storage capacitor Cst may be connected between the first node N1 and the third node N3 of the driving transistor DRT according to a type of the driving transistor DRT. The anode electrode of the light emitting diode EL may be electrically connected to the second node N2 of the driving transistor DRT, and a base voltage EVSS may be supplied to a cathode electrode of the light emitting diode EL.

Here, the base voltage EVSS may be the ground voltage or a voltage higher or lower than the ground voltage. In addition, the base voltage EVSS may be varied depending on the driving condition. For example, the base voltage EVSS during the display driving period may be different from the base voltage EVSS during the sensing period.

The structure of the subpixel SP described as an example above is a 3T1C (3 Transistors 1 Capacitor) structure, which is only an example for explanation, and further includes one or more transistors, or in some cases, further includes one or more capacitors. Alternatively, each of the plurality of subpixels SP may have the same structure, or some of the plurality of subpixels SP may have different structures.

The display device 100 according to an embodiment of the present disclosure may use a method for measuring a current flowing by voltage charged in the storage capacitor Cst during a sensing period of the characteristic value for the driving transistor DRT in order to effectually sense the characteristic value of the driving transistor DRT like threshold voltage or mobility. Such a method may be referred to as a current sensing operation.

That is, the characteristic value or variation of the characteristic value of the driving transistor DRT in the subpixel SP may be determined by measuring the current flowing by voltage charged in the storage capacitor Cst during the sensing period of the characteristic value for the driving transistor DRT.

At this time, the reference voltage line RVL may be referred to as a sensing line since the reference voltage line RVL serves not only to supply the reference voltage-for-sensing Vref but also serves as a sensing line for sensing the characteristic value of the characteristic value for the driving transistor DRT in the subpixel SP.

More specifically, the characteristic value or variation of the characteristic value for the driving transistor DRT may correspond to a difference (e.g., Vdata−Vref) between the voltage of the first node N1 and the voltage of the second node N2 of the driving transistor DRT.

The sensing operation for the characteristic value of the driving transistor DRT may be performed by, for example, a sensing circuit of characteristic value included in the data driving circuit 130.

Figure 4:
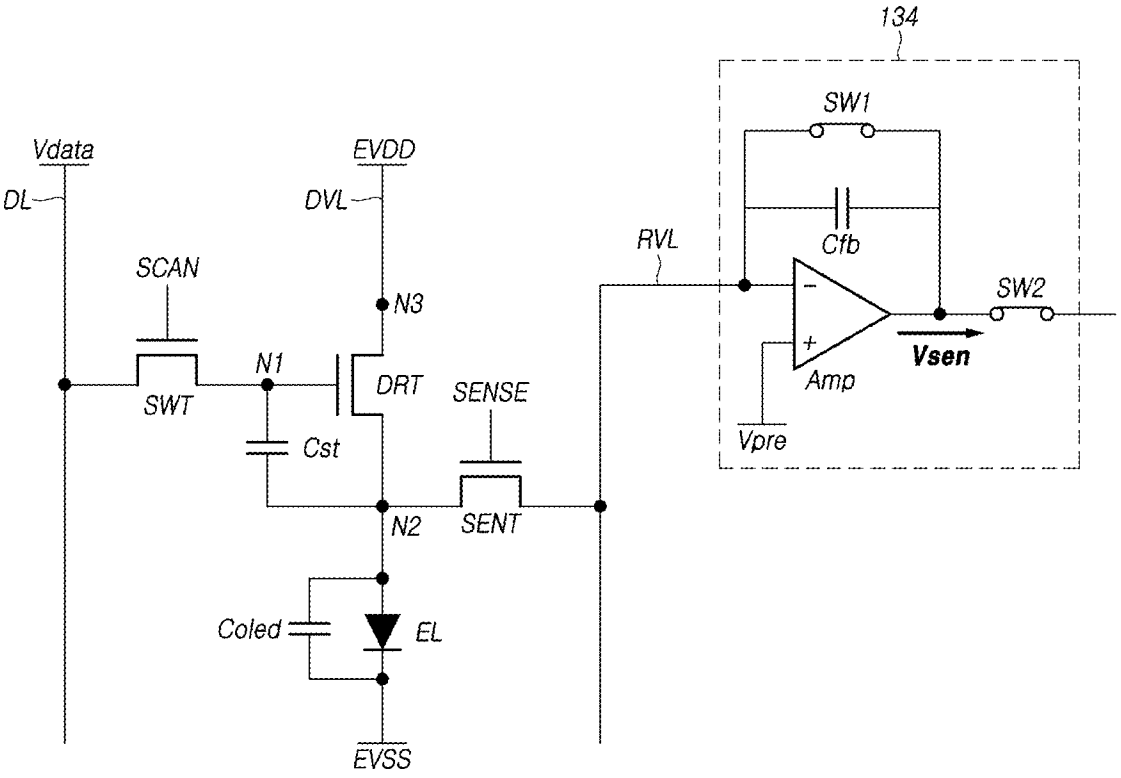
FIG. 4 illustrates a sensing circuit of characteristic value for sensing characteristic values of driving transistors in the display device according to embodiments of the present disclosure.

FIG. 4 illustrates a sensing circuit of characteristic value for sensing characteristic values of driving transistors in the display device according to embodiments of the present disclosure.

Referring to FIG. 4, in the display 100 device according to one or more embodiments, the data driving circuit 130 may supply the data voltage Vdata at the level of the data voltage-for-sensing through the data line DL in a period for sensing the characteristic value of the driving transistor DRT, and supply the reference voltage-for-sensing through the reference voltage line RVL. At this time, the data voltage-for-sensing supplied through the data line DL may be about 14V, and the reference voltage-for-sensing supplied through the reference voltage line RVL may be about 4V.

As a result, due to a voltage difference formed between the first node N1 and the second node N2 of the driving transistor DRT, the storage capacitor Cst can be charged.

At this time, the driving voltage EVDD supplied through the driving voltage line DVL during the sensing period for the characteristic value of the driving transistor DRT may be equal to or lower than the driving voltage supplied during the image driving period of the display panel.

The sensing circuit 134 of characteristic value included in the data driver 130 senses the capacitance charged in the storage capacitor Cst of the driving transistor DRT and supplies a sensed characteristic value Vsen according to the sensed capacitance.

The supplied sensed characteristic value Vsen may be transmitted to the timing controller 140 and the timing controller 140 determines the characteristic value or variation of the characteristic value of the driving transistor DRT from the sensed characteristic value Vsen.

When there is variation in the characteristic value of the driving transistor DRT, the timing controller 140 supplies the compensated data voltage Vdata to the corresponding subpixel SP according to variation of the characteristic value, so that it is possible to reduce luminance non-uniformity of corresponding subpixels SP.

The sensing circuit 134 of characteristic value may have various structures, for example, a feedback capacitor Cfb and an amplifier. In this case, it may include an initializing switch SW1 for initializing the feedback capacitor Cfb and a sampling switch SW2 for sampling the sensed characteristic value Vsen.

In the amplifier, the reference voltage-for-comparing Vpre may be supplied to the non-inverting input terminal (+), and the inverting input terminal (−) may be connected to the reference voltage line RVL. The feedback capacitor Cfb and the initializing switch SW1 may be electrically connected between the inverting input terminal (−) and the output terminal of the amplifier.

When the feedback capacitor Cfb is charged by the capacitance in the storage capacitor Cst of the driving transistor DRT, the variation of capacitance charged in the storage capacitor Cst may be sensed in accordance with the variation of the characteristic value of the driving transistor DRT.

At this time, since the amplifier generates a value in the negative direction as the capacitance charged in the feedback capacitor Cfb increases, the sensed characteristic value Vsen may be increased by decreasing of the capacitance charged in the storage capacitor Cst due to variation of the characteristic value of the driving transistor DRT.

Meanwhile, the display device 100 according to the one or more embodiments may include a memory stored with a reference sensing voltage in advance, and a compensating circuit for compensating the deviation of the characteristic value by comparing the reference sensing voltage stored in the memory with the sensed characteristic value measured in the sensing circuit 134 of characteristic value.

The memory and the compensating circuit may be embedded in the timing controller 140.

The compensation value calculated by the compensating circuit may be stored in the memory and the controller 140 may change the image data to be supplied to the data driving circuit 130 using the compensation value calculated by the compensating circuit, and supply the changed image data to the data driving circuit 130.

Accordingly, the data driving circuit 130 supplies the changed image data to the corresponding data line DL, so that the deviation of the characteristic value (e.g., the deviation of threshold voltage, the deviation of the mobility) for the driving transistor DRT in the corresponding subpixel SP may be compensated.

Figure 5:
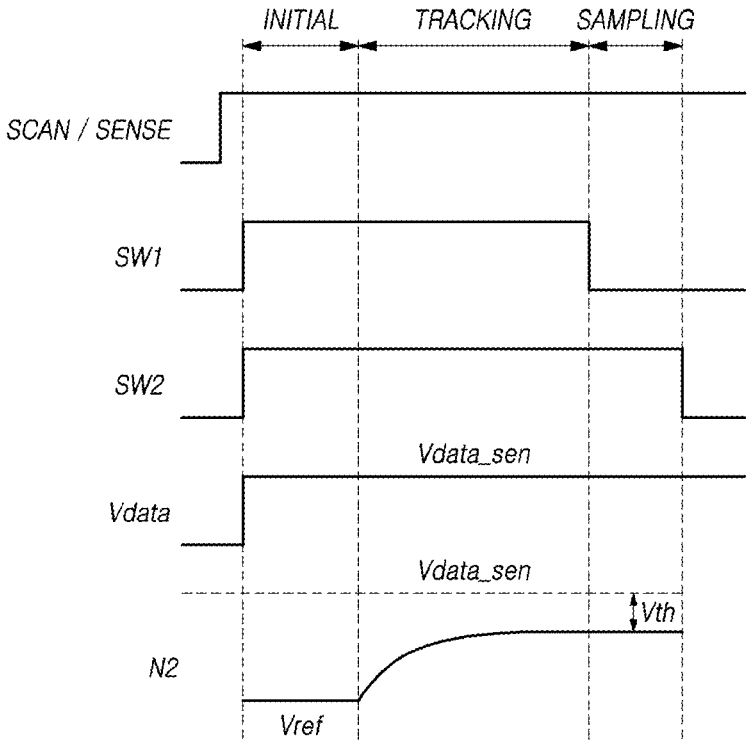
FIG. 5 illustrates a signal timing diagram for sensing a threshold voltage of a driving transistor in the display device according to embodiments of the present disclosure.

FIG. 5 illustrates a signal timing diagram for sensing a threshold voltage of a driving transistor in the display device according to embodiments of the present disclosure.

Referring to FIG. 5, a sensing process for the threshold voltage Vth of the driving transistor DRT may be comprised of an initializing period INITIAL, a tracking period TRACKING, and a sampling period SAMPLING.

Since the switching transistor SWT and the sensing transistor SENT are simultaneously turned on and turned off for sensing the threshold voltage Vth of the driving transistor DRT, the scan signal SCAN and the sense signal SENSE may be supplied simultaneously through a gate line GL or the scan signal SCAN and the sense signal SENSE may be supplied at the same time through different gate lines GL.

The initializing period INITIAL is a period to charge the second node N2 of the driving transistor DRT with the reference voltage-for-sensing Vref for sensing the threshold voltage Vth of the driving transistor DRT, and the scan signal SCAN and the sense signal SENSE with a high level may be supplied through the gate line GL.

The tracking period TRACKING is a period to charge the storage capacitor Cst after completing the charge for the second node N2 of the driving transistor DRT.

The sampling period SAMPLING is a period to detect a current flowing by the capacitance charged in the storage capacitor Cst after the storage capacitor Cst of the driving transistor DRT is charged.

In the initializing period INITIAL, the switching transistor SWT is turned on by supplying simultaneously the scan signal SCAN and the sense signal SENSE with turn-on level. As a result, the first node N1 of the driving transistor DRT is initialized to the data voltage-for-sensing Vdata_sen for sensing the threshold voltage Vth.

In addition, the scan signal SCAN and the sense signal SENSE with a turn-on level cause the sensing transistor SENT to be turned on. In this state, the second node N2 of the driving transistor DRT is initialized to the reference voltage-for-sensing Vref by the reference voltage-for-sensing Vref supplied through the reference voltage line RVL.

The tracking period TRACKING is a period to track the threshold voltage Vth of the driving transistor DRT. In other words, the tracking period TRACKING is a period to track the second node N2 of the driving transistor DRT corresponding to the threshold voltage Vth of the driving transistor DRT. In the tracking period TRACKING, the switching transistor SWT and the sensing transistor SENT are maintained to turn-on level and the reference voltage-for-sensing Vref transmitted through the reference voltage line RVL is blocked.

Accordingly, the second node N2 of the driving transistor DRT is floated, so that the voltage of the second node N2 of the driving transistor DRT is increased from the reference voltage-for-sensing Vref. At this time, since the sensing transistor SENT is turned on, the rising voltage at the second node N2 of the driving transistor DRT leads to the rise of the voltage at the reference voltage line RVL.

At this time, while the initializing switch SW1 in the sensing circuit 134 of the characteristic value is turned on, electric charges are not charged in the feedback capacitor Cfb.

In this process, the voltage at the second node N2 of the driving transistor DRT rises and becomes a saturation state. The saturation voltage at the second node N2 of the driving transistor DRT at the saturation state corresponds to the difference (Vdata_sen−Vth) between the data voltage-for-sensing Vdata_sen for sensing the threshold voltage Vth and the threshold voltage Vth of the driving transistor DRT.

In the sampling period SAMPLING, the scan signal SCAN and the sense signal SENSE with a high level are maintained in the gate line GL, the initializing switch SW1 in the sensing circuit 134 of the characteristic value is turned off, and the sampling switch SW2 is maintained at a turned-on state. At this time, since the initializing switch SW1 in the sensing circuit 134 of the characteristic value is turned off, the electric charge in the storage capacitor Cst of the driving transistor DRT is transmitted to the feedback capacitor Cfb.

An amplifier Amp in the sensing circuit 134 of the characteristic value generates the sensed characteristic value Vsen according to the amount of charge in the feedback capacitor Cfb. The sensed characteristic value Vsen is generated in the negative direction as the amount of charge in the feedback capacitor Cfb increases. Therefore, when the amount of charge in the storage capacitor Cst decreases due to deterioration of the driving transistor DRT, the amount of charge in the feedback capacitor Cfb decreases, and as a result, the amplifier Amp generates the sensed characteristic value Vsen with higher level than before deterioration. Accordingly, the deterioration of the driving transistor DRT may be sensed using the sensed characteristic value Vsen in this way.

Figure 6:
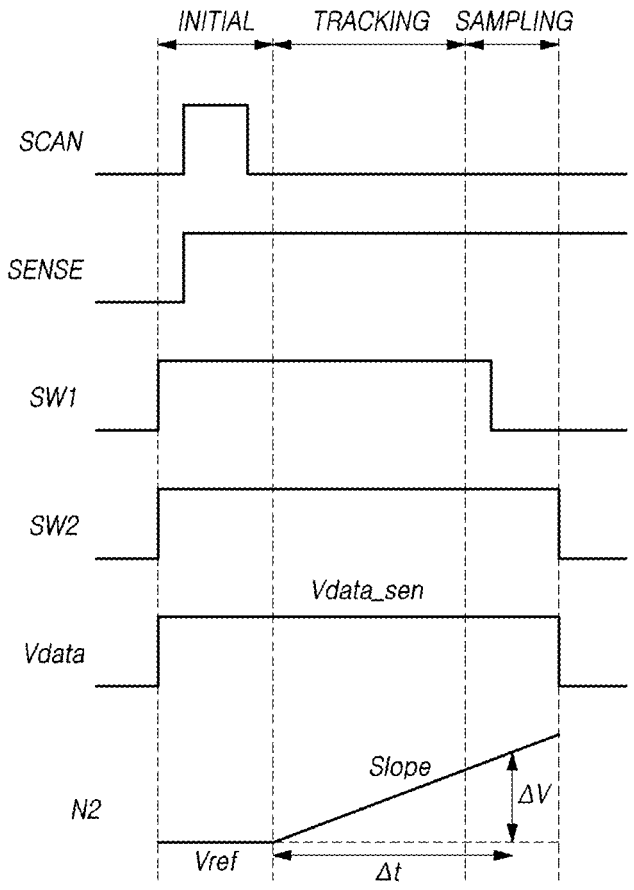
FIG. 6 illustrates a signal timing diagram for sensing a mobility of the driving transistor in the display device according to embodiments of the present disclosure.

FIG. 6 illustrates a signal timing diagram for sensing a mobility of the driving transistor in the display device according to embodiments of the present disclosure.

Referring to FIG. 6, a sensing process for the mobility of the driving transistor DRT in the display device 100 according to embodiments of the present disclosure may be comprised of an initializing period INITIAL, a tracking period TRACKING, and a sampling period SAMPLING like the sensing process for the threshold voltage Vth.

In the initializing period INITIAL, the switching transistor SWT is turned on by the scan signal SCAN with the turn-on level, so that the first node N1 of the driving transistor DRT is initialized to the data voltage Vdata for sensing the mobility. In addition, the sense signal SENSE with a turn-on level causes the sensing transistor SENT to be turned on. In this state, the second node N2 of the driving transistor DRT is initialized to the reference voltage-for-sensing Vref.

The tracking period TRACKING is a period to track the mobility of the driving transistor DRT. The mobility of the driving transistor DRT may indicate current driving ability of the driving transistor DRT. In the tracking period TRACKING, the voltage at the second node N2 of the driving transistor DRT is tracked for determining the mobility of the driving transistor DRT.

In the tracking period TRACKING, the switching transistor SWT is turned off by the scan signal SCAN with a turn-off level, and a switch to receive the reference voltage-for-sensing Vref is blocked. Consequently, both the first node N1 and the second node N2 of the driving transistor DRT are floated, so that both the voltage at the first node N1 and the voltage at the second node N2 of the driving transistor DRT are increased.

In particular, since the voltage at the second node N2 of the driving transistor DRT was initialized to the reference voltage-for-sensing Vref, it is increased from the reference voltage-for-sensing Vref. At this time, an increase of the voltage at the second node N2 of the driving transistor DRT causes an increase of the voltage at the reference voltage line RVL, since the sensing transistor SENT is in the turned-on state.

In the sampling period SAMPLING, the initializing switch SW1 in the sensing circuit 134 of the characteristic value is turned off at a point that a predetermined time Δt has elapsed from the time when the voltage of the second node N2 of the driving transistor DRT starts to increase. At this time, the feedback capacitor Cfb is not charged before the initializing switch SW1 in the sensing circuit 134 of the characteristic value is turned off. Then, the electric charge in the storage capacitor Cst of the driving transistor DRT is transmitted to the feedback capacitor Cfb in the sensing circuit 134 of the characteristic value while the initializing switch SW1 in the sensing circuit 134 of the characteristic value is turned off and the sampling switch SW2 is turned on.

At this time, the amplifier Amp in the sensing circuit 134 of the characteristic value generates a sensed characteristic value Vsen according to the amount of charge in the feedback capacitor Cfb. The sensed characteristic value may correspond to a voltage (Vref+ΔV) increased from the reference voltage-for-sensing Vref by some voltage ΔV. Accordingly, the mobility of the driving transistor DRT may be determined by using the sensed characteristic value (Vref+ΔV), the known reference voltage-for-sensing Vref, and the charging time ΔT of the feedback capacitor Cfb.

That is, the mobility of the driving transistor DRT is proportional to the voltage variation per unit time ΔV/Δt of the reference voltage line RVL through the tracking period TRACKING and the sampling period SAMPLING. Therefore, the mobility of the driving transistor DRT may be proportional to the slope of the voltage in the reference voltage line RVL.

At this time, a compensating circuit connected to the sensing circuit 134 of the characteristic value may compare the mobility determined for the driving transistor DRT to the reference mobility or a mobility of the other driving transistor DRT, and may compensate the deviation of the mobility among the driving transistors DRT. Here, the compensation for the deviation of the mobility may be performed through a logic process of adding or multiplying a compensation value to the digital image data DATA.

As described above, the sensing period for the characteristic value (the threshold voltage or the mobility) of the driving transistor DRT may be proceed after a power-on signal is generated and before the display driving operation is started.

For example, when the power-on signal is supplied to the display device 100, the timing controller 140 loads parameters necessary for driving the display panel 110 and then performs a display driving operation. In this case, the parameters necessary for driving the display panel 110 may include information about the sensing process and compensation process for characteristic value previously performed by the display panel 110. The sensing process for the characteristic value (the threshold voltage or the mobility) of the driving transistor DRT may be performed during the parameter loading process. As described above, the sensing process for the characteristic value during the parameter loading process after the power-on signal is generated may be referred to as an on-sensing process.

Alternatively, the sensing process for the characteristic value of the driving transistor DRT may be performed after the power-off signal for the display device 100 is generated. For example, when the power-off signal is generated in the display device 100, the timing controller 140 may terminate the image display process in the display panel 110, and perform the sensing process for the characteristic value of the driving transistor DRT during a predetermined time. In this way, the sensing process for the characteristic value in a state in which the power-off signal is generated and the image displaying process is terminated may be referred to as an off-sensing process.

In addition, the sensing period for the characteristic value of the driving transistor DRT may be performed in real time while the display driving process is progressed. This sensing process may be referred to as a real-time RT sensing process. In the case of the real-time sensing process, the sensing process may be performed for one or more subpixels SP in one or more subpixel lines for each blank period during the display driving period.

That is, a blank period in which the data voltage is not supplied to the subpixel SP may exist within one frame or between the nth frame and the (n+1)th frame during the display driving period in which an image is displayed on the display panel 110. Accordingly, the sensing process of the mobility for one or more subpixels SP may be performed in the blank period.

As described above, when the sensing process is performed in the blank period, the subpixel SP line on which the sensing process is performed may be randomly selected. Accordingly, abnormal phenomenon that may appear in the display driving period may be diminished after the sensing process in the blank period is performed. In addition, after the sensing process is performed during the blank period, a recovery data voltage may be supplied to the subpixel SP on which the sensing process was performed during the display driving period. Accordingly, abnormal phenomenon in the subpixel SP line for which the sensing process is completed in the display driving period after the sensing process in the blank period may be further diminished.

At this time, since the sensing process for the threshold voltage of the driving transistor DRT may take a long time for saturating the voltage at the second node N2 of the driving transistor DRT, the sensing and compensating process for the threshold voltage Vth is mainly performed in the off-sensing process. On the other hand, since the sensing process for the mobility of the driving transistor DRT takes a relatively short time compared to the sensing process for the threshold voltage Vth, the sensing and compensating process for the mobility may be performed in the real-time sensing process.

However, a compensation error may be occurred as the temperature of a specific area increases due to internal or external factors in the display device 100.

Figure 7:
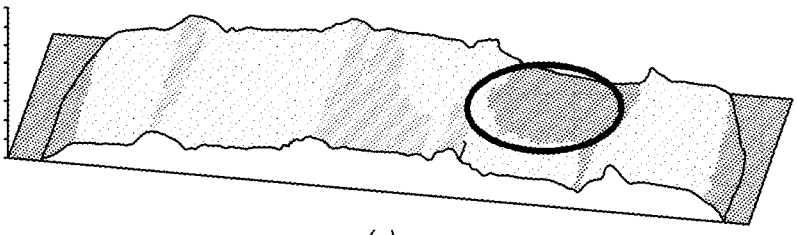
FIG. 7 illustrates a diagram of a case in which a distortion due to a compensation error occurs in a partial area of a display panel owing to an internal or external factor in the display device according to embodiments of the present disclosure.
Figure 7:
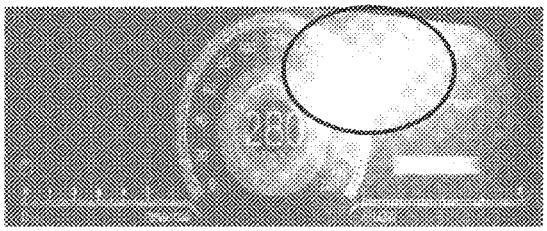

FIG. 7 illustrates a diagram of a case in which a distortion due to a compensation error occurs in a partial area of a display panel owing to an internal or external factor in the display device according to embodiments of the present disclosure.

Referring to FIG. 7, a temperature of a specific area in the display panel 110 may be increased rapidly, and characteristic values in partial areas may be changed due to an increase of a sunlight or the temperature of the surrounding area in the process of supplying data voltage to the display panel 110 by the data driving circuit 130 disposed in the display device 100 according to embodiments of the present disclosure.

Accordingly, when the compensation is performed based on the characteristic value changed due to the increase of the internal temperature or the surrounding temperature of the display panel 110, a specific area may be excessively compensated by the data voltage Vdata for compensating the characteristic value as shown (a) in FIG. 7. In addition, as a result, a partial area of the display panel 110 may be distorted due to a compensation error that exceeds the range of normal compensation for deterioration as shown in (b) of FIG. 7.

In order to solve this problem, the display device 100 according to embodiments of the present disclosure discloses a method for accurately detecting and compensating a deviation of the characteristic values in a local area of the display panel 110.

Figure 8:
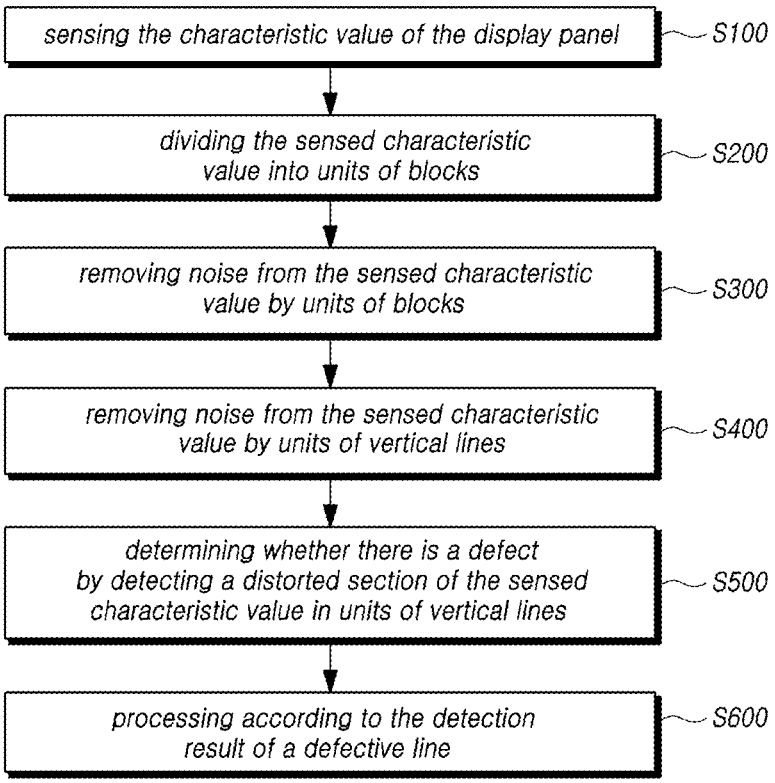
FIG. 8 illustrates a flowchart of a driving method in the display device according to embodiments of the present disclosure.

FIG. 8 illustrates a flowchart of a driving method in the display device according to embodiments of the present disclosure.

Referring to FIG. 8, the driving method of the display device 100 according to embodiments of the present disclosure may include a step S100 of sensing the characteristic value of the display panel 110, a step S200 of dividing the sensed characteristic value Vsen into units of blocks, a step S300 of removing noise from the sensed characteristic value Vsen for each block, a step S400 of removing noise from the sensed characteristic value Vsen for each vertical line, a step S500 of determining whether there is a defect by detecting a distorted section of the sensed characteristic value Vsen for each vertical line, and a step S600 of processing according to the detection result of a defective line.

The step S100 of sensing the characteristic value of the display panel 110 is a process of sensing the characteristic value such as a threshold voltage or mobility of the driving transistor DRT for the subpixels SP arranged in the display panel 110 through the sensing circuit 134 of the characteristic value included in the data driving circuit 130.

The step S200 of dividing the sensed characteristic value Vsen into units of blocks is a process of dividing the subpixels SP arranged in the display panel 110 into units of blocks, and dividing the sensed characteristic value Vsen so as to correspond to the subpixels SP by each unit of blocks.

Figure 9:
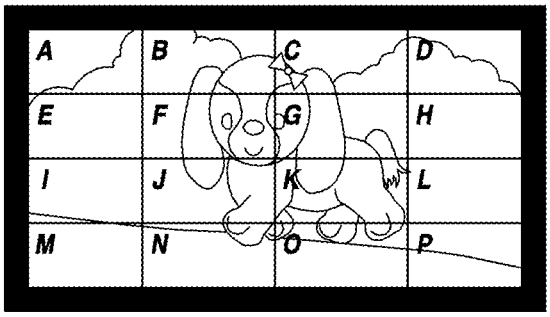
FIG. 9 illustrates a diagram in which a display panel is divided into a plurality of blocks in order to divide a sensed characteristic value into a plurality of blocks in a driving method of the display device according to embodiments of the present disclosure.

FIG. 9 illustrates a diagram in which a display panel is divided into a plurality of blocks in order to divide a sensed characteristic value into a plurality of blocks in a driving method of the display device according to embodiments of the present disclosure.

Referring to FIG. 9, the display device 100 according to embodiments of the present disclosure may divide an area to which data voltage Vdata is supplied in every frame unit into matrix-shaped blocks A-P in horizontal and vertical directions in the display panel 110 and may store the sensed characteristic value Vsen for each block in a memory for each block.

In order to distinguish the sensed characteristic value Vsen, the number and size of blocks A-P divided in the display panel 110 may be changed according to the size and resolution of the display panel 110.

As described above, it is possible to detect luminance distortion or compensation error in a specific area, that is, a partial local area of the display panel 110 by dividing the sensed characteristic value Vsen into units of blocks.

The step S300 of removing noise from the sensed characteristic value Vsen for each block is a process of removing the noise that may be occurred in a block located at a specific area.

For the purpose above, the noise generated at a specific block may be removed by comparing an average of the sensed characteristic value Vsen for each block and an average of the sensed characteristic value Vsen for entire display panel 110, calculating a deviation of the sensed characteristic value Vsen for each block, and normalizing the sensed characteristic value Vsen for each block.

Figure 10:
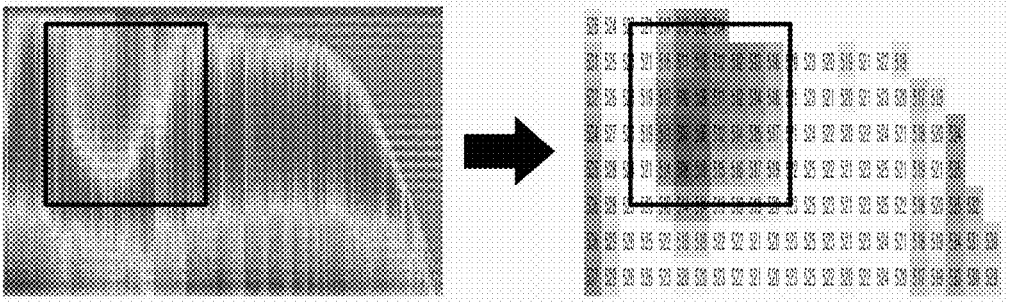
FIG. 10 illustrates an example of a sensed characteristic values when noise is removed from a specific block in the driving method of the display device according to embodiments of the present disclosure.

FIG. 10 illustrates an example of a sensed characteristic values when noise is removed from a specific block in the driving method of the display device according to embodiments of the present disclosure.

In this case, the average of the sensed characteristic values Vsen for each block may be calculated based on a single frame, or may be calculated by accumulating in units of predetermined a plurality of frames.

The step S400 of removing noise from the sensed characteristic value Vsen for each vertical line is a process of removing the noise from the sensed characteristic value Vsen for subpixels SP for each vertical line parallel to the data lines DL to which the data voltages Vdata are supplied.

Since the data driving circuit 130 is disposed above the display panel 110 and the data lines DL are arranged in the vertical direction in above, subpixel lines arranged in a direction parallel to the data lines DL to which the data voltages Vdata are supplied are illustrated as vertical lines.

Figure 11:
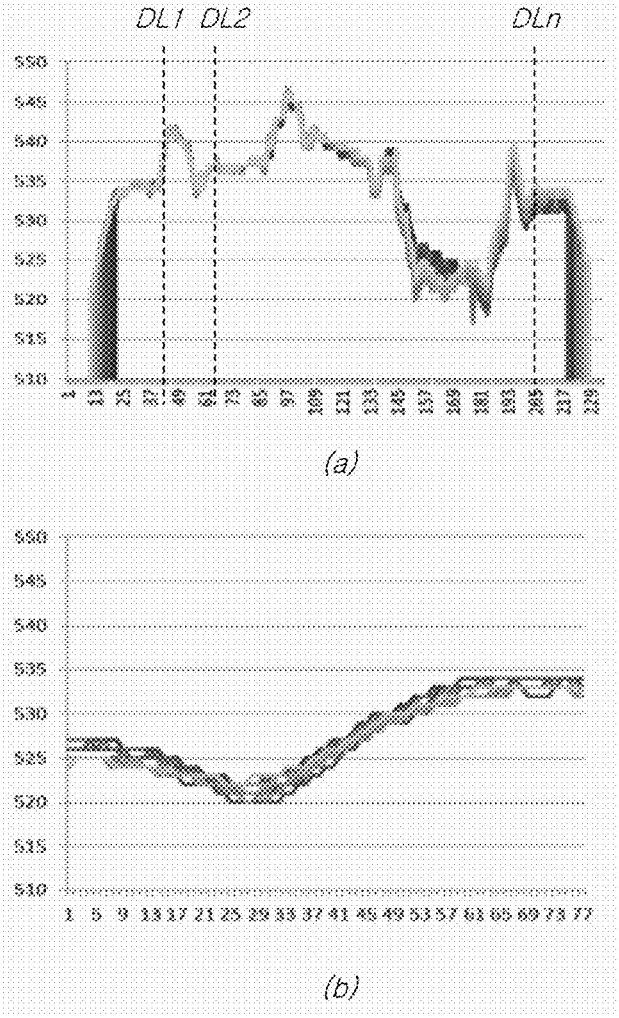
FIG. 11 illustrates a diagram of a distribution of the sensed characteristic values in relation with a horizontal line and a vertical line in the driving method of the display device according to embodiments of the present disclosure.

FIG. 11 illustrates a diagram of a distribution of the sensed characteristic values in relation with a horizontal line and a vertical line in the driving method of the display device according to embodiments of the present disclosure.

As illustrated in FIG. 11, when the data lines DL of the display device 100 according to embodiments of the present disclosure are arranged in the vertical direction of the display panel 110, the sensed characteristic value Vsen for the horizontal lines may have a large variation in the sensing characteristic value Vsen due to a variation due to a deviation of the data voltages Vdata between the adjacent data lines DL, and as a result, it may be difficult to determine the noise. (in case of (a) in FIG. 11).

That is, if the sensed characteristic value Vsen in is detected for each horizontal line, it is difficult to determine the defection based on the sensed characteristic value Vsen for each block due to the deviation of the data voltages Vdata between the adjacent data lines DL.

In contrast, when the sensed characteristic value Vsen for the subpixels SP is detected for each vertical line parallel to the data lines DL to which the data voltages Vdata are supplied, the data voltages Vdata between adjacent subpixels SP may be changed slowly due to a transfer characteristic of the data voltages Vdata (in the case of (b) in FIG. 11).

Accordingly, it is effective to remove noise from the sensed characteristic value Vsen for the subpixels SP for each vertical line parallel to the data lines DL to which the data voltages Vdata are supplied.

For example, it is possible to remove the noise from the sensed characteristic value Vsen for each vertical line by applying an average filter or a median filter to the sensed characteristic value Vsen detected for each vertical line.

The step S500 of determining whether there is a defect by detecting a distorted section of the sensed characteristic value Vsen for each vertical line is a process of determining whether there is a defect such as a compensation error for corresponding blocks by determining whether there is a distorted section with a variation above the reference value in the sensed characteristic value Vsen detected for each vertical line parallel to the data lines DL to be supplied the data voltages Vdata.

Figure 12:
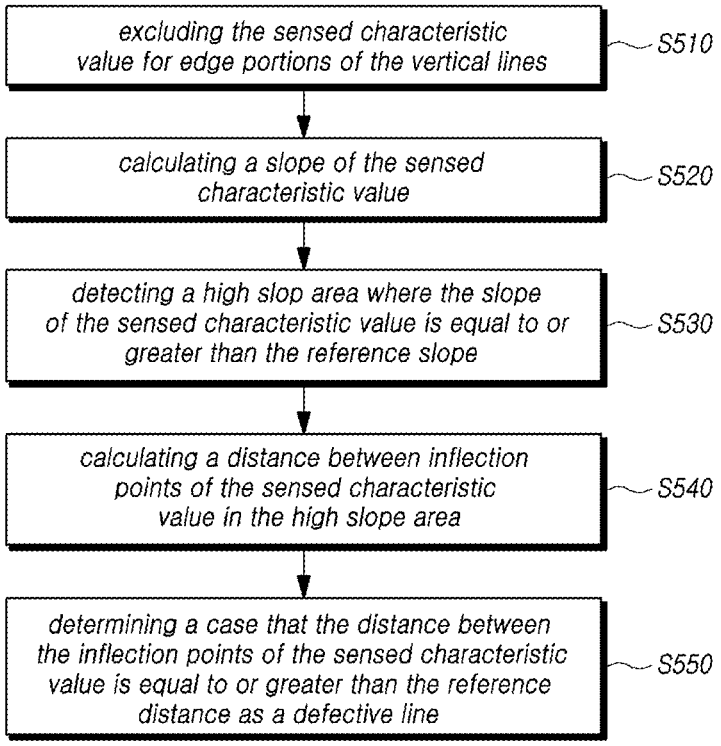
FIG. 12 illustrates a detailed flowchart for a step of determining whether there is a defect by detecting a distorted section of sensed characteristic values for each vertical line, in the driving method of the display device according to embodiments of the present disclosure.

FIG. 12 illustrates a detailed flowchart for a step of determining whether there is a defect by detecting a distorted section of sensed characteristic values for each vertical line, in the driving method of the display device according to embodiments of the present disclosure.

Referring to FIG. 12, the step S500 of determining whether there is a defect by detecting a distorted section of the sensed characteristic value Vsen for each vertical line in the driving method of the display device 100 according to embodiments of the present disclosure may include a step S510 of excluding the sensed characteristic value Vsen for edge portions of the vertical lines, a step S520 of calculating a slope of the sensed characteristic value Vsen, a step S530 of detecting a high slop area where the slope of the sensed characteristic value Vsen is equal to or greater than the reference slope, a step S540 of calculating a distance between inflection points of the sensed characteristic value Vsen in the high slope area, and a step S550 of determining a case that the distance between the inflection points of the sensed characteristic value Vsen is equal to or greater than the reference distance as a defective line.

The step S510 of excluding the sensed characteristic value Vsen for edge portions of the vertical lines is a process of excluding the sensed characteristic value Vsen corresponding to the edge portions from the sensed characteristic values Vsen of the vertical lines.

Figure 13:
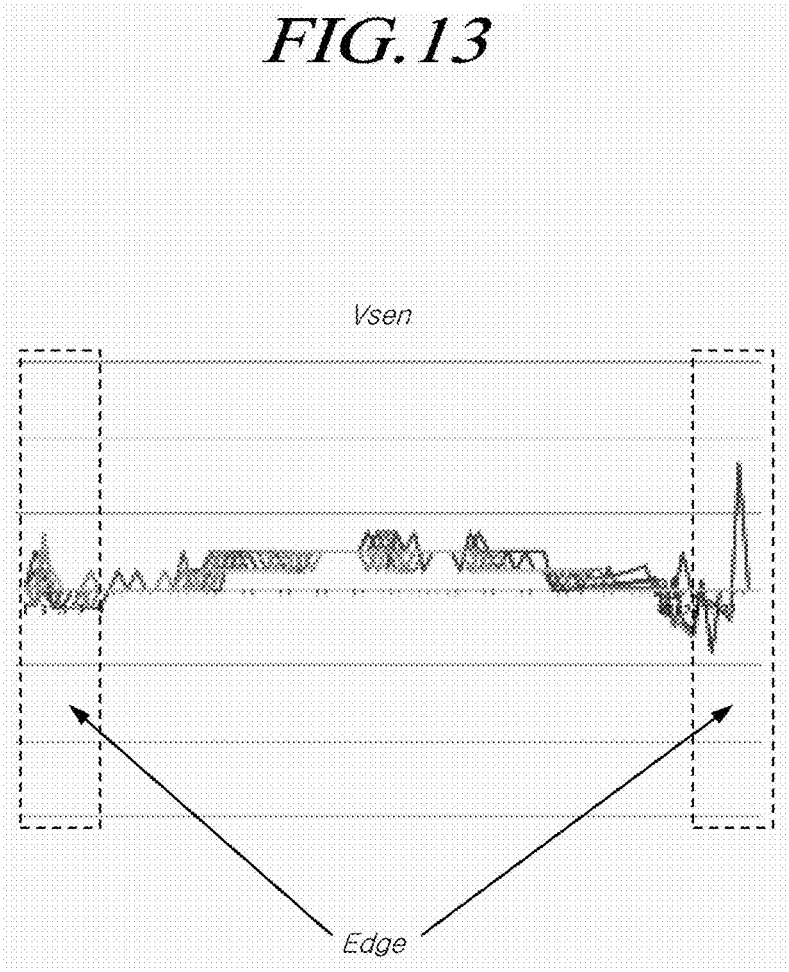
FIG. 13 illustrates a case in which the sensed characteristic value corresponding to an edge portion is excluded from the sensed characteristic values in the vertical line, in the driving method of the display device according to embodiments of the present disclosure.

FIG. 13 illustrates a case in which the sensed characteristic value corresponding to an edge portion is excluded from the sensed characteristic values in the vertical line, in the driving method of the display device according to embodiments of the present disclosure.

Referring to FIG. 13, in the driving method of the display device 100 according to embodiments of the present disclosure, an edge portion for each vertical line parallel to the data lines DL may be a closest portion and a farthest portion to the data driving circuit 130. Accordingly, when the data driving circuit 130 is located at upper area of the display panel 110, the edge portion may include some subpixels SP located at the top of the display panel 110 and some subpixels SP located at the bottom of the display panel 110.

Since some subpixels SP located at the top of the display panel 110 and some subpixels SP located at the bottom of the display panel 110 are adjacent to bezel area or circuit area of the display panel 110, the sensed characteristic value Vsen detected in the edge portion of the vertical lines may contain a lot of noise, and thus, the deterioration state of the subpixels SP may not be properly reflected.

Therefore, it is preferable to exclude the sensed characteristic value Vsen corresponding to the edge portion from the sensed characteristic values Vsen of the vertical lines.

The step S520 of calculating a slope of the sensed characteristic value Vsen is a process of calculating the slope by differentiating the sensed characteristic value Vsen except the edge portion.

Since the slope of the sensed characteristic value Vsen represents the amount of variation of the sensed characteristic value Vsen over time, it is possible to confirm the instantaneous variation of the sensed characteristic value Vsen by calculating the slope of the sensed characteristic value Vsen.

The step S530 of detecting a high slop area where the slope of the sensed characteristic value Vsen is equal to or greater than the reference slope is a process of detecting an area that instantaneous variation of the sensed characteristic value Vsen is equal to or greater than a reference variation.

Figure 14:
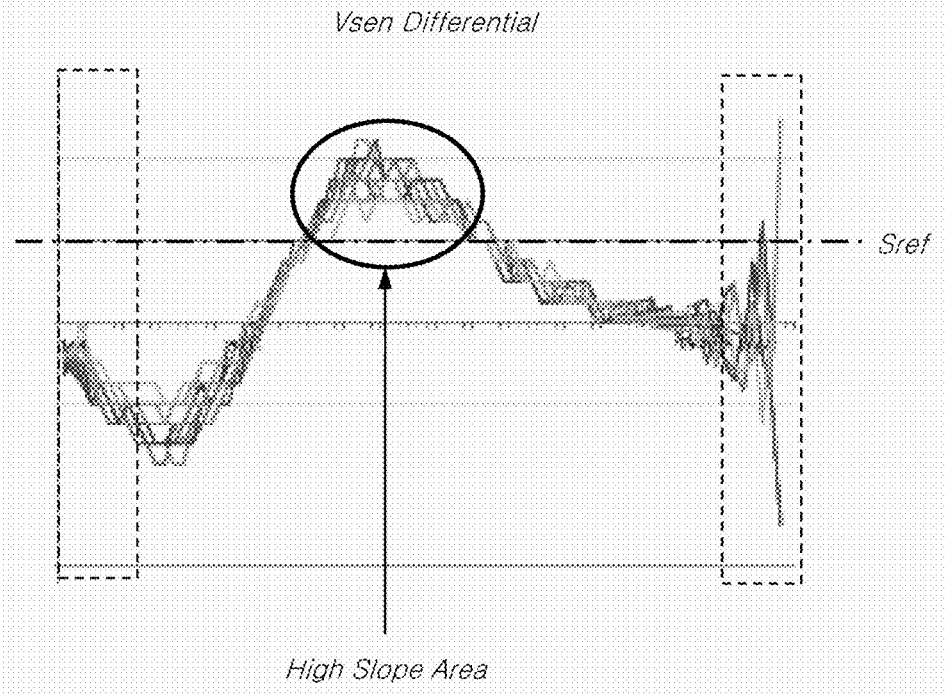
FIG. 14 illustrates a case of detecting a high slope area in which a slope corresponding to an instant various amount is greater than or equal to a reference slope among sensed characteristic values except edge portion, in the driving method of the display device according to embodiments of the present disclosure.

FIG. 14 illustrates a case of detecting a high slope area in which a slope corresponding to an instant various amount is greater than or equal to a reference slope among sensed characteristic values except edge portion, in the driving method of the display device according to embodiments of the present disclosure.

Referring to FIG. 14, in the driving method of the display device 100 according to embodiments of the present disclosure, the slope of the sensed characteristic value Vsen except edge portion may appear in the form of a continuous curve.

At this time, since the slope of the sensed characteristic value Vsen represents the amount of variation of the sensed characteristic value Vsen over time, the high slope area in which the slope of the sensed characteristic value Vsen is equal to or greater than the reference slope Sref corresponds to an area in which the instantaneous variation of the sensed characteristic value Vsen is equal to or greater than the reference variation.

Accordingly, the high slope area in which the slope of the sensed characteristic value Vsen is equal to or greater than the reference slope Sref is an area in which the sensed characteristic value Vsen is excessively changed due to an internal or external sudden environmental factor (e.g., high temperature) in the display panel 110.

The step S540 of calculating a distance between inflection points of the sensed characteristic value Vsen in the high slope area is a process of detecting variation range of the sensed characteristic value Vsen in the high slope area in which the slope of the sensed characteristic value Vsen is equal to or greater than the reference slope Sref.

Figure 15:
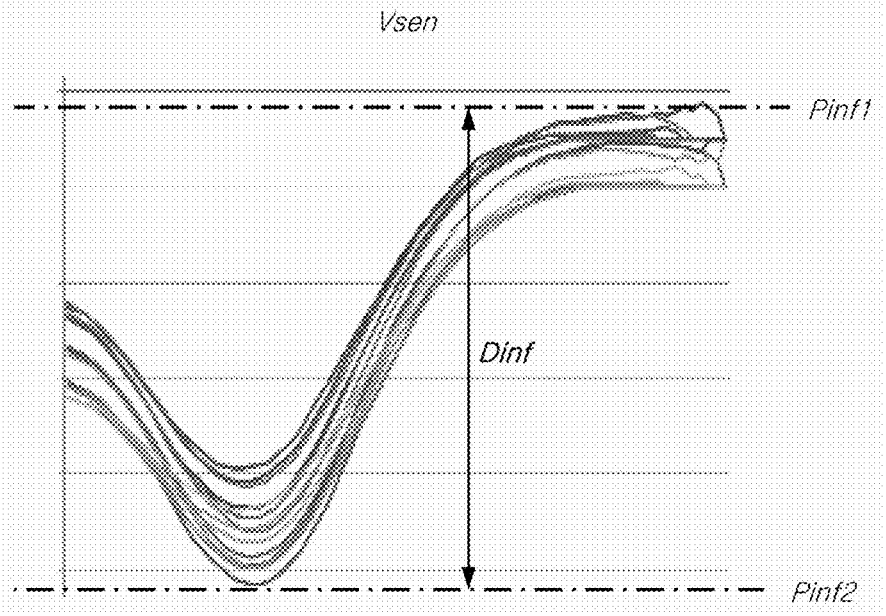
FIG. 15 illustrates a case of calculating a distance between inflection points of the sensed characteristic value in the high slope area, in the driving method of the display device according to embodiments of the present disclosure.

FIG. 15 illustrates a case of calculating a distance between inflection points of the sensed characteristic value in the high slope area, in the driving method of the display device according to embodiments of the present disclosure.

Referring to FIG. 15, in the driving method of the display device 100 according to embodiments of the present disclosure, the sensed characteristic value Vsen in the high slope area in which the slope of the sensed characteristic value Vsen is equal to or greater than the reference slope Sref may be appeared in the form of a sine wave with various shapes.

Accordingly, the sensed characteristic value Vsen in the high slope area may have a high inflection point Pinf1 in which the sensed characteristic value Vsen falls after rising, and a low inflection point Pinf2 in which the sensed characteristic value Vsen rises after falling.

At this time, the distance between the high inflection point Pinf1 in which the sensed characteristic value Vsen falls after rising, and the low inflection point Pinf2 in which the sensed characteristic value Vsen rises after falling corresponds to a distance Dinf between the inflection points.

The distance Dinf between the high inflection point Pinf1 in which the sensed characteristic value Vsen falls after rising, and the low inflection point Pinf2 in which the sensed characteristic value Vsen rises after falling represents the variation of the sensed characteristic value Vsen.

The step S550 of determining a case that the distance between the inflection points of the sensed characteristic value Vsen is equal to or greater than the reference distance as a defective line is a process of determining a compensation error for vertical lines in a block based on the distance Dinf between the inflection points of the sensed characteristic value Vsen in the high slope area in which the slope of the sensed characteristic value Vsen is equal to or greater than the reference slope Sref.

That is, in the high slope area in which the slope of the sensed characteristic value Vsen is equal to or greater than the reference slope Sref, it may be determined that a luminance distortion is occurred by excessive compensation applied to the vertical lines in the block due to internal or external factors (high temperature, etc.) when a variation corresponding the distance Dinf between the high inflection point Pinf1 in which the sensed characteristic value Vsen falls after rising, and the low inflection point Pinf2 in which the sensed characteristic value Vsen rises after falling is greater than the reference distance.

Figure 16:
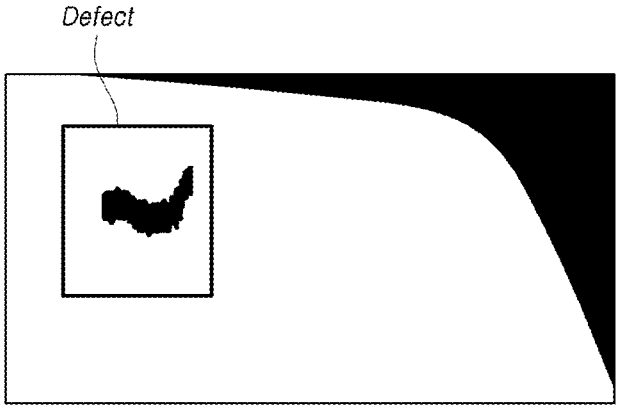
FIG. 16 illustrates a case in which a vertical line in a specific block is determined as a defective line in the driving method of the display device according to embodiments of the present disclosure.

FIG. 16 illustrates a case in which a vertical line in a specific block is determined as a defective line in the driving method of the display device according to embodiments of the present disclosure.

As described above, a counter action against the luminance distortion may be taken according to the detection result when the defective line is detected in a specific block in a vertical direction parallel to the data lines DL.

The step S600 of processing according to the detection result of a defective line is a process of determining a processing method for the display device 100 according to the detection result when a defective line is detected in a specific block.

For example, when a defective line is detected in a specific block, the block in which the defective line is detected and the normal block may be compensated with different characteristic values, or if it is difficult to compensate, a defective product may be determined.

Figure 17:
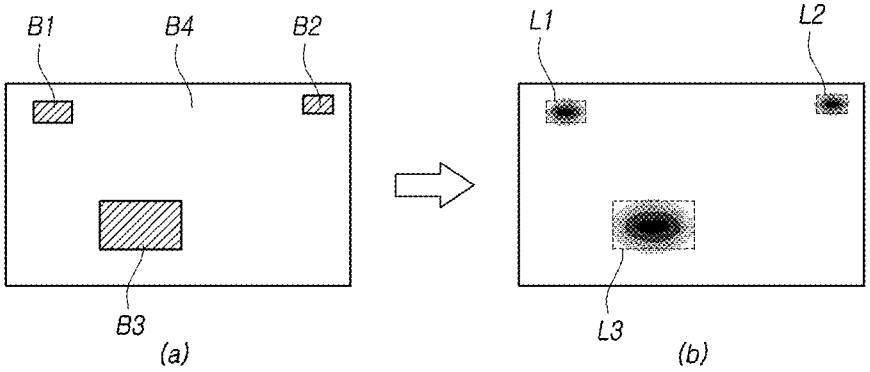
FIG. 17 illustrates a case in which compensating operations with different characteristic values were performed respectively to blocks with defective lines in the driving method of the display device according to embodiments of the present disclosure.

FIG. 17 illustrates a case in which compensating operations with different characteristic values were performed respectively to blocks with defective lines in the driving method of the display device according to embodiments of the present disclosure.

Referring to FIG. 17, in the driving method of the display device 100 according to embodiments of the present disclosure, it may determine a normal block B4 and defective blocks B1, B2, B3 with defective lines based on the sensed characteristic value Vsen detected for each vertical line of the display panel 110, and apply compensation gains differently for the characteristic values according to a number of defective lines in defective blocks B1, B2, B3 with defective lines.

That is, the compensating circuit may receive information about the defective blocks B1, B2, B3 with the defective lines from the sensing circuit 134 of the characteristic value and supply the compensation data with different compensation gains as the data voltages of the corresponding blocks.

For example, the compensating circuit may apply differently the compensation gains for the characteristic value so that each of the defective blocks B1, B2, B3 with the defective lines have different compensation luminance L1, L2, L3.

On the other hand, when the defective lines in a specific block are detected above a certain reference, it may be determined that it is difficult to compensate for the luminance distortion by differently applying compensation gains for the defective blocks, and it may be determined that the display panel 110 is regarded as a defective product.

It will be apparent to those skilled in the art that various modifications and variations can be made in the display device and the driving method thereof of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device comprising:

a display panel including a plurality of gate lines extending in a first direction, a plurality of data lines extending in a second direction, and a plurality of subpixels;

a gate driving circuit for supplying scan signals to the plurality of gate lines;

a data driving circuit for supplying data voltages to the plurality of data lines and including a sensing circuit of characteristic value to sense the characteristic value of the plurality of subpixels; and a timing controller for controlling the gate driving circuit and the data driving circuit, and determining a defective line by detecting a distorted section for the sensed characteristic value for each subpixel arranged in the second direction with respect to a plurality of blocks corresponding to the display panel, wherein the timing controller calculates a slope of the sensed characteristic value except the sensed characteristic value for an edge portion of the subpixels arranged in the second direction, detects a high slope area in which a slope of the sensed characteristic value is equal to or greater than a reference slope, calculates a distance between inflection points of the sensed characteristic value in the high slope area, and determines a case in which the distance between the inflection points of the sensed characteristic value is equal to or greater than a reference distance as the defective line.

2. The display device according to claim 1, wherein the plurality of subpixels include:

a light emitting element;

a driving transistor providing current to the light emitting element;

a switching transistor electrically connected between a gate node of the driving transistor and the data line;

a sensing transistor electrically connected between a source node or a drain node of the driving transistor and a reference voltage line; and a storage capacitor electrically connected between a gate node and a source node or a drain node of the switching transistor.

3. The display device according to claim 2, wherein the sensing circuit of characteristic value includes:

an amplifier in which an inverting input terminal is connected to the reference voltage line connected to a source node or a drain node of the sensing transistor and a non-inverting input terminal to be supplied a reference voltage-for-comparing;

a feedback capacitor electrically connected between the inverting input terminal and an output terminal of the amplifier;

an initializing switch connected in parallel with the feedback capacitor; and a sampling switch located at the output terminal of the amplifier.

4. The display device according to claim 1, wherein the timing controller divides the sensed characteristic value of the display panel for each block, removes noise of the sensed characteristic value for each block, removes noise of the sensed characteristic value for each subpixel arranged in the second direction, and determines a defective line by detecting a distorted section of the sensed characteristic value for each subpixel arranged in the second direction.

5. The display device according to claim 4, wherein the timing controller calculates a deviation of the sensed characteristic values for each block by comparing an average of the sensed characteristic values for each block with an average of the sensed characteristic values in the entire display panel, and removes the noise of the sensed characteristic value by normalizing the sensed characteristic values for each block with the deviation of the sensed characteristic values.

6. The display device according to claim 1, wherein the timing controller further includes a compensating circuit for providing compensation data with different compensation gains to blocks with the defective lines as data voltage.

7. The display device according to claim 1, wherein the timing controller determines the display panel as a defective product when the detected defective lines exceed a reference number.

8. A driving method of a display device including a display panel comprised of a plurality of gate lines extending in a first direction, a plurality of data lines extending in a second direction, and a plurality of subpixels, a gate driving circuit for supplying scan signals to the plurality of gate lines, and a data driving circuit for supplying data voltages to the plurality of data lines and sensing a characteristic value of the plurality of subpixels, comprising:

dividing the sensed characteristic value into units of blocks; and determining a defective line by detecting a distorted section for the sensed characteristic value for each subpixel arranged in the second direction wherein the determining the defective line includes calculating a slope of the sensed characteristic value except the sensed characteristic value for an edge portion of the subpixels arranged in the second direction, detecting a high slope area in which a slope of the sensed characteristic value is equal to or greater than a reference slope, calculating a distance between inflection points of the sensed characteristic value in the high slope area, and determining a case in which the distance between the inflection points of the sensed characteristic value is equal to or greater than a reference distance as the defective line.

9. The driving method of a display device according to claim 8, further comprising:

removing noise from the sensed characteristic value for each block; and removing noise from the sensed characteristic value for each subpixel arranged in the second direction.

10. The driving method of a display device according to claim 8, further includes providing compensation data with different compensation gains to blocks with the defective lines as data voltage.

11. The driving method of a display device according to claim 8, further includes determining the display panel as a defective product when the detected defective lines exceed a reference number.

12. The driving method of a display device according to claim 9, wherein the removing noise from the sensed characteristic value for each block includes:

comparing an average of the sensed characteristic values for each block with an average of the sensed characteristic values for entire display panel;

calculating a deviation of the sensed characteristic value for each block; and normalizing the sensed characteristic value for each block using the deviation of the sensed characteristic value.

* * * * *